US007027750B2

(12) United States Patent
Cho et al.

(10) Patent No.: US 7,027,750 B2
(45) Date of Patent: Apr. 11, 2006

(54) WARMING-UP METHOD FOR ELECTROPHOTOGRAPHY IMAGE FORMING APPARATUS USING TWO DRIVING DEVICES

(75) Inventors: Won-mo Cho, Suwon-si (KR); Sung-tack Byun, Suwon-si (KR)

(73) Assignee: Samsung Electronics Co., Ltd., (KR)

( * ) Notice: Subject to any disclaimer, the term of this patent is extended or adjusted under 35 U.S.C. 154(b) by 83 days.

(21) Appl. No.: 10/867,640

(22) Filed: Jun. 16, 2004

(65) Prior Publication Data

US 2005/0074253 A1 Apr. 7, 2005

(30) Foreign Application Priority Data

Oct. 1, 2003 (KR) ..... 10-2003-0068219

(51) Int. Cl.
*G03G 15/20* (2006.01)

(52) U.S. Cl. ..... 399/70

(58) Field of Classification Search ..... None
See application file for complete search history.

(56) References Cited

FOREIGN PATENT DOCUMENTS

| | | |
|---|---|---|
| JP | 05006125 A * | 1/1993 |
| JP | 05035148 | 2/1993 |
| JP | 2001-051541 | 2/2001 |
| JP | 2001051533 | 2/2001 |
| JP | 2001051541 | 2/2001 |
| JP | 2001265159 | 9/2001 |
| JP | 2002169404 | 6/2002 |

* cited by examiner

*Primary Examiner*—Quana Grainger
(74) *Attorney, Agent, or Firm*—Roylance, Abrams, Berdo & Goodman L.L.P.

(57) ABSTRACT

A warming-up method for an electrophotography image forming apparatus. The warming-up method includes the steps of turning on a heat source when the image forming apparatus is turned on or when a wake-up event is generated in a power saving mode, driving an image fix-related driving body for rotating a heated roller and a pressing roller, thereby heating the rollers; driving a main driving body and rotating an OPC drum after driving the image fix-related driving body; and stopping the sub-driving body and the main driving body when surface temperature of the heated roller and surface temperature of the pressing roller reach an objective temperature, respectively, by means of heat from the heat source and rotation of the heated roller and the pressing roller.

10 Claims, 4 Drawing Sheets

WARMING-UP METHOD FOR ELECTROPHOTOGRAPHY IMAGE FORMING APPARATUS USING TWO DRIVING DEVICES

CROSS-REFERENCE TO RELATED APPLICATIONS

This application claims the benefit under 35 U.S.C. § 119(a) of Korean Patent Application No. 2003-68219 filed Oct. 1, 2003, in the Korean Intellectual Property Office, the entire contents of which is incorporated herein by reference.

BACKGROUND OF THE INVENTION

1. Field of the Invention

The present invention relates to a method of warming-up an electrophotography image forming apparatus. More particularly, the present invention relates to a method of warming-up an electrophotography image forming apparatus, capable of enhancing a performance efficiency of a pressing roller within a short time by driving an image fix-related driving body built in the electrophotography image forming apparatus immediately after a wake-up event is generated or when power is turned on, thereby securing a warming-up temperature of the pressing roller in advance.

2. Description of the Related Art

An electrophotography technique is often used in image forming apparatuses such as laser beam printers, copiers, or plain paper fax machines.

FIG. 1 illustrates a conventional image forming apparatus 10 employing a related art electrophotography. As shown in FIG. 1, the image forming apparatus 10 includes a charged roller 11 for printing an image data on a print paper, an organic photo conductive (OPC) drum 12, an exposing device 13, a developing roller 14, a transfer roller 15, a pick up roller 16, and a fixer 18. In an exemplary print process, a high voltage is provided to the charged roller 11. The charged roller 11 rotates and charges a photosensitive body applied to a peripheral surface of the OPC drum 12. Then a light generated by the exposing device 13 forms on the surface of the charged OPC drum 12 and forms an electrostatic latent image for printing. Later, a toner supplied from the developing roller 14 is applied to the electrostatic latent image formed on the surface of the OPC drum 12, and forms a visualized image. The high-voltage transfer roller 15 transfers the visualized image formed on a transported print paper 17. The visualized image being transferred to the print paper 17 is affixed onto the print paper 17 under high heat and high pressure from a heated roller 19 and a pressing roller 20 that are built in the fixer 18.

Usually, the image forming apparatus 10 operates in one of the following four modes: a printing mode, a ready mode, a power-saving mode, and a warming-up mode. To maintain and advance these modes, more than one driving body is required to be inside the image forming apparatus 10. Another related driving body is also set to work when the image forming apparatus 10 is turned on or changes from the power-saving mode to the warming-up mode when the wake-up event is generated. In other words, the image forming apparatus 10 has two driving bodies. One is a main driving body that is related to rotation of the OPC drum 12, and the other is an image fix-related driving body that is related to an image fixing process. According to a related art algorithm, when the heated roller 19 reaches a warming-up starting temperature after power-on or generation of the wake-up event, the main driving body connected to the OPC drum 12 and the image fix-related driving body connected to the fixer 18 are, respectively, set to drive for the warming-up, to raise temperature of the heated roller 18 up to a warming-up objective temperature. There are differences in these two driving bodies in terms of driving objectives. Through the main driving body's action, the OPC drum 12 is evenly charged by the high voltage provided by the charged roller 11, and through the image fix-related driving body's action, the heated roller 19 and the pressing roller 20 are, respectively, rotated and warmed up to an appropriate temperature for fixing an image. Because the OPC drum 12 has a short lifespan and is very expensive, it is set to rotate only for a predetermined time in order to prevent any damages from frequent rotations. However, in case of the related art image forming apparatus, temperature transition of the pressing roller 20 is disregarded, and thus both driving bodies are designed to drive together at the same point. That is, the main driving body and the image fix-related driving body start driving together following power-on or generation of the wake-up event, or from a certain warming-up starting point. This is because the same algorithm applied to an image forming apparatus having one single driving body is applied to the image forming apparatus having the main driving body and the image fix-related driving body, and also because the main driving body is driven only for a predetermined time to reduce damage in the OPC drum 12. However, it is not necessary that the main driving body and the image fix-related body always drive together. Moreover, a heat source built in the heated roller 19 starts driving from the warming-up starting point. As the heat source drives and the pressing roller 20 and the heated roller 19 rotate, temperature of the heated roller and the pressing roller 20 reaches an objective temperature, respectively. More specifically, the heated roller 19 is heated directly by the heat source therein while the pressing roller 20 is heated using an indirect method. In other words heat is transferred from the heated roller 19 as the pressing roller 20 is in contact with the heated roller 19. The heated roller 19 is heated more than the pressing roller 20 because the heated roller 19 has its own source for raising temperature. Therefore, the pressing roller 20, which is heated indirectly, takes a relatively longer time to get to its objective temperature. Accordingly, even after the heat source is turned off because the heated roller 19 reached the warming-up objective temperature, there needs to be a predetermined time for heat transfer from the heated roller 19 to the pressing roller 20. In fact, this is a major factor that determines standby time for the warming-up period. As discussed above, the conventional warming-up method requires a long period of time to transfer heat from the heated roller 19 to the pressing roller 20, thereby consuming more time for the warming-up, which indicates that a user has to wait longer before using the image forming apparatus. Therefore, an improved warming-up method is required to solve the above-mentioned problem.

SUMMARY OF THE INVENTION

The present invention has been developed in order to solve the above drawbacks and other problems associated with the conventional arrangement. An aspect of the present invention is to provide a warming-up method for an electrophotography image forming apparatus using two driving devices, in which a main driving body and an image fix-related driving body each operate under an independent algorithm. Thus, by driving the image fix-related driving body immediately after generation of a wake-up event or following power-on, a pressing roller and a heated roller can be rotated from the beginning, and thus, a temperature of the pressed roller can reach an objective temperature as soon as possible.

To achieve the above object, there is provided a warming-up method for an electrophotography image forming apparatus including an image fix-related driving body for rotating a heated roller with a built-in heat source and a pressing roller in contact with the heated roller, and a main driving body for rotating an organic photo conductive (OPC) drum. The method comprises turning on the heat source when the image forming apparatus is turned on or when a wake-up event is generated in a power saving mode, driving the image fix-related driving body (a sub-driving body) to rotate the heated roller and the pressing roller, thereby heating the rollers; driving the main driving body and rotating the OPC drum after driving the image fix-related driving body; and stopping the sub-driving body and the main driving body when a surface temperature of the heated roller and the surface temperature of the pressing roller reach an objective temperature, respectively, by means of heat from the heat source and rotation of the heated roller and the pressing roller.

In an exemplary embodiment, it is determined whether the surface temperature of the heated roller reaches a warming-up starting temperature, by means of the heat from the heat source and the rotation of the heated roller and the pressing roller, and when the surface temperature of the heated roller reaches the warming-up starting temperature, the main driving body is driven and the OPC drum is rotated.

The present invention can reduce a warming-up time period and thus the waiting time of a user.

BRIEF DESCRIPTION OF THE DRAWINGS

The above aspects and features of the present invention will be more apparent by describing certain embodiments of the present invention with reference to the accompanying drawings, in which.

In the following description of the present invention, the same drawing reference numerals are used for the same elements throughout the drawings.

DETAILED DESCRIPTION OF THE PREFERRED EMBODIMENTS

Certain embodiments of the present invention will be described in greater detail with reference to the accompanying drawings.

In the following description of the present invention, exemplary diagrams and elements are provided. However, the present invention is not limited to the exemplary diagrams and elements. Thus, it should be apparent that the present invention can be performed without the specific examples used. Also, well-known functions or constructions are not described in detail since they would unnecessarily obscure the invention.

Embodiments of the present invention will now be described in detail with reference to the accompanying drawings.

Figure 1:
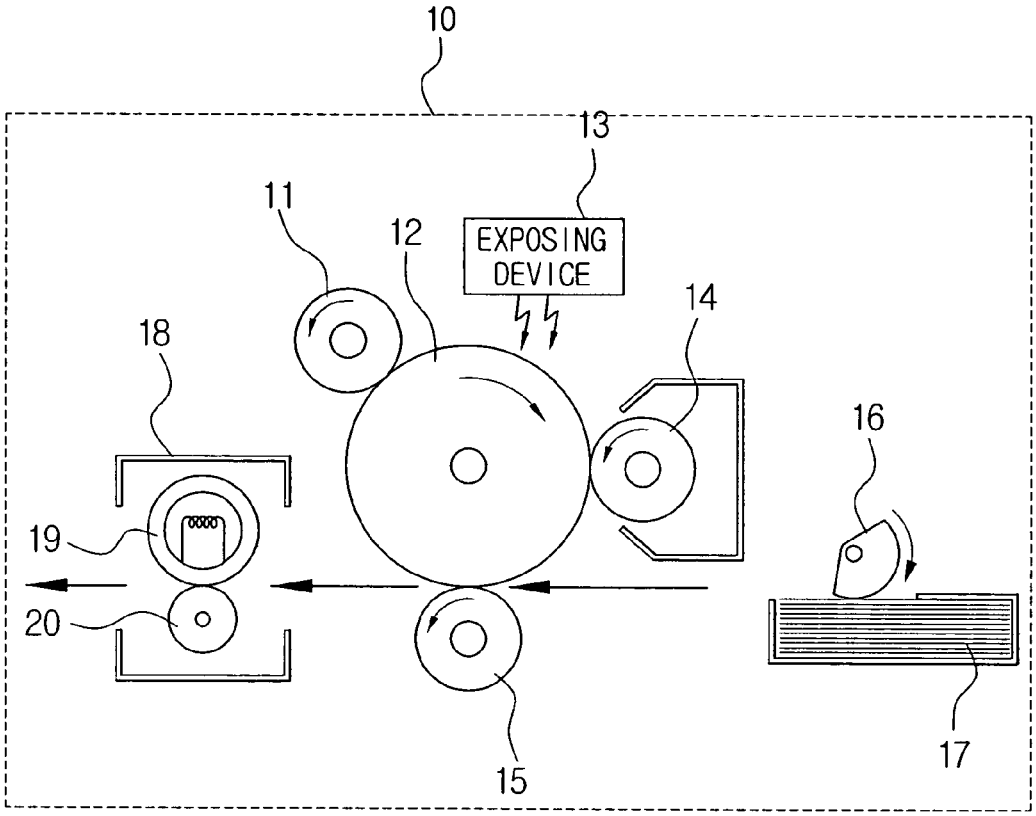
FIG. 1 (PRIOR ART)
FIG. 1 is a schematic diagram illustrating a conventional electrophotography image forming apparatus.
Figure 2:
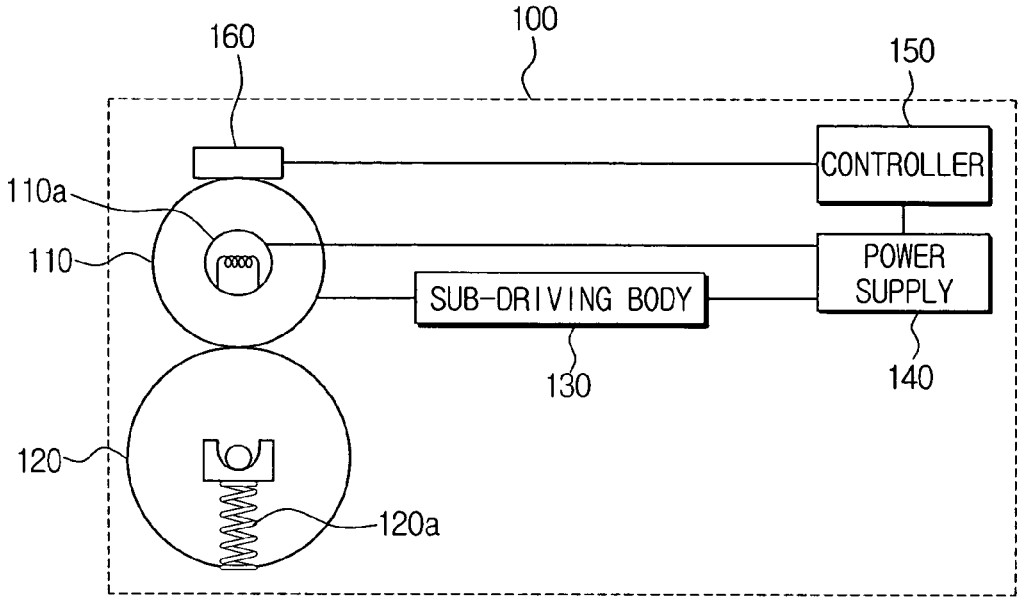
FIG. 2 is a schematic diagram illustrating an image forming apparatus using a warming-up method in accordance with an embodiment of the present invention.

FIG. 2 is a schematic diagram illustrating an image forming apparatus using a warming-up method in accordance with an embodiment of the present invention. The image forming apparatus 100 according to an embodiment of the present invention includes a heated roller 110, a pressing roller 120, a sub-driving body 130, a power supply 140, a controller 150, and a temperature detecting means 160. The sub-driving body 130 is an image fix-related driving body. It is referred to as the 'sub-driving body' to distinguish it from a main driving body related to an organic photo conductive (OPC) drum (not shown).

The heated roller 110 is a part of a fixer, and heated by a heat source 110*a* installed therein. When the image forming apparatus 100 is turned on or turns from a power-saving mode to a warming-up mode at the generation of a wake-up event, the heat source 110*a* is turned on by an applied voltage fed from the power supply 140. Also, the temperature detecting means 160 is mounted at a predetermined position of the heated roller 110 to detect the surface temperature of the heated roller 110, and transfers the detected temperature to the controller 150. Preferably, a thermistor is used as the temperature detecting means 160. The controller 150, based on the transmitted surface temperature being detected, determines whether a present surface temperature is appropriate for image fixing, and determines to turn on or off the heat source 110*a* on the basis of the determination.

The pressing roller 120 together with the heated roller 110 comprise the fixer. A pressing spring 120*a* is attached to a shaft (not shown) of the pressing roller 120, to press the pressing roller 120 against the heated roller 110 tightly. Therefore, when a print paper to which a visualized image is transferred passes between the heated roller 110 and the pressing roller 120, the transferred visualized image is fixed onto the print paper by heat and pressure from the rollers.

The heated roller 110 uses the sub-driving body 130 as a driving source. To accomplish this, a connected gear connected to the sub-driving body 130 is pivotably fixed at one end of the heated roller 110, and the pressing roller 120 is rotated by a contact force generated between the rollers.

The controller 150 controls the image forming apparatus, including a warming-up time period, a warming-up temperature and so forth. That is, when the image forming apparatus 100 is turned on or wakes up from the power-saving mode, the controller 150 controls the power supply 140 so that the heat source 110 can be turned on. According to an embodiment of the present invention, the controller 150 controls the power supply 140 to ensure that the sub-driving body 130 starts driving immediately after the heat source 110*a* is turned on. The controller 150, based on the surface temperature provided by the temperature detecting means 160, determines whether to turn on the heat source 110*a*, whether to drive the sub-driving body 130, and whether to drive the main driving body (not shown). On the basis of the determination, the controller 150 controls the power supply 140.

Figure 3:
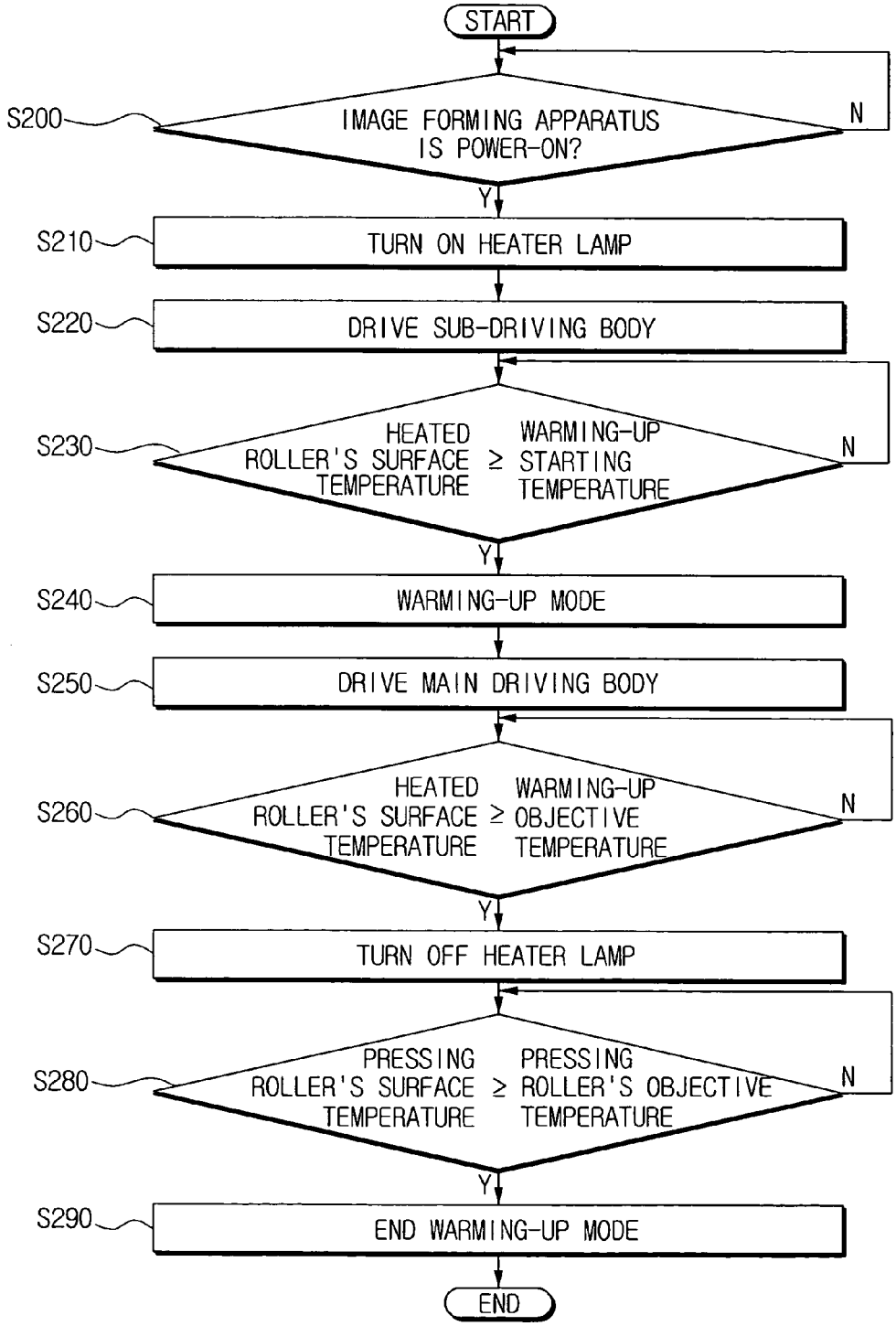
FIG. 3 is a flow chart describing a warming-up method according to an embodiment of the present invention.

FIG. 3 is a flow chart describing the warming-up method in accordance with an embodiment of the present invention. For convenience, a warming-up starting point is limited to the case where power of the image forming apparatus 100 is on.

When the image forming apparatus 100 is turned on at step S200, the controller 150, in response thereof, controls the power supply 140 to turn on the heat source 110*a* at step S210. Also, the controller 150 controls the power supply 140 to start driving the sub-driving body 130 at step 220. As the sub-driving body 130 starts driving, the heated roller 110 rotates, and the pressing roller in contact with the heated roller 110 rotates also. In this manner, heat transfer from the heated roller 110 to the pressing roller 120 is actively done at step S220. The temperature detecting means 160 selectively detects the surface temperature of the heated roller, and reports the detected surface temperatures to the controller 150. Then the controller 150 determines whether the transferred surface temperature has reached the warming-up starting temperature at step 230. If not, the controller 150 continues the detection process to determine whether the transferred surface temperature has reached to the warming-up starting temperature. If the surface temperature has reached the warming-up starting temperature, the controller 150 recognizes that a present state of the image forming apparatus is ready for the warming-up mode at step S240. According to an embodiment of the present invention, at this point, the temperature of the heated roller 110 as well as the temperature of the pressing roller 120 is already at a predetermined high surface temperature, respectively. Accordingly, at the warming-up starting point, the surface temperature of the pressing roller 120 according to an embodiment of the present invention is relatively higher than that of the conventional devices, whereby the objective temperature of the pressing roller can be achieved more quickly.

The controller 150 drives the main driving body (not shown) related to the OPC drum (not shown) at step S250, and electrifies the OPC drum. On the other hand, since the heat source 110*a* has already been driven, the surface temperature of the heated roller continuously increases. Similarly, the surface temperature of the pressing roller 120, compared to the surface temperature at the warming-up starting point, continuously increased. Based on the detected surface temperature provided by the temperature detecting means 160, the controller 150 determines whether the surface temperature of the heated roller 110 has reached the warming-up objective temperature at step 260. If the warming-up objective temperature has been reached, the controller 150 controls the power supply 140 to cut off power supply to the heat source 110 at step S270. However, the sub-driving body 130 does not stop driving even after power to the heat source 110*a* is cut off, and the pressing roller 120 in contact with the heated roller 110 continues to rotate. Through rotation of the pressing roller 120 in contact with the heated roller 110, the heat of the heated roller 110 is transferred to the pressing roller 120, resulting in an increase of the temperature of the pressing roller 120. Based on the transferred surface temperature from the temperature detecting means 160, the controller 150 determines whether the surface temperature of the pressing roller 120 has reached its objective temperature at step S280. There are diverse methods for detecting the surface temperature of the pressing roller 120. In an exemplary embodiment of the present invention, a certain time interval can be predetermined according to the initial setting conditions of the image forming apparatus such that the surface temperature of the pressing roller 120 is assumed to have reached the objective temperature of the pressing roller 120 after the predetermined time interval from the turn-off of the heat source 110*a*. The predetermined time interval may be set differently in consideration of different printing environments. However, the present invention is not limited thereby. Once it is determined that the surface temperature of the pressing roller is raised as high as the objective temperature, the controller 150 ends the whole process for warming up the present image forming apparatus at step S290.

Figure 4:
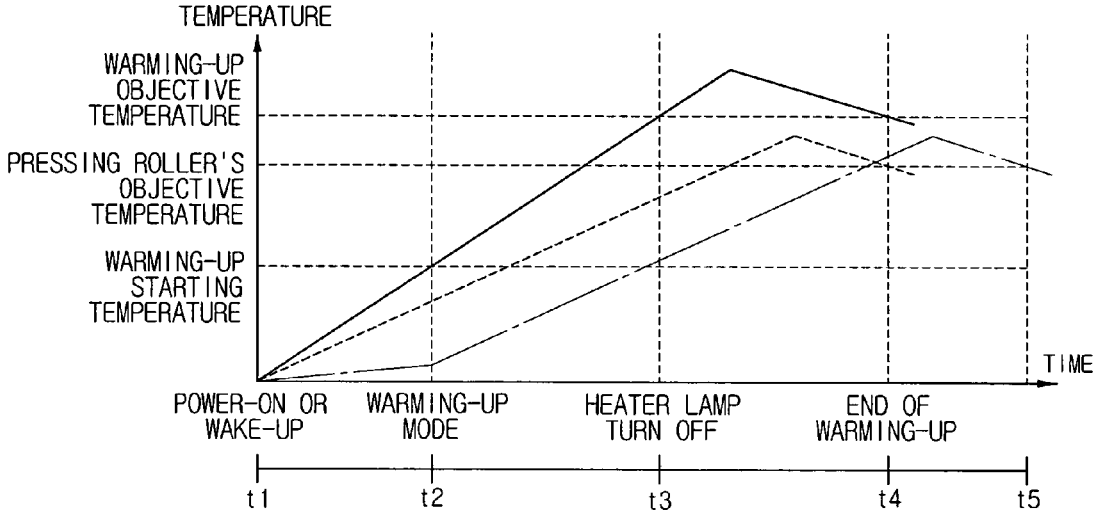
FIG. 4 is a timing diagram comparing a transition of surface temperature of a heated roller and a pressing roller based on a warming-up method in accordance with an embodiment of the present invention to a transition of surface temperature of a heated roller and a pressing roller based on a conventional warming-up method.

FIG. 4 is a timing diagram comparing a transition of the surface temperature of the heated roller and the pressing roller based on the warming-up method in accordance with an embodiment of the present invention to a transition of the surface temperature of the heated roller and the pressing roller based on a conventional warming-up method. FIGS. 2 through 4 will also be referred to. In FIG. 4, the solid line indicates a temperature transition line of the heated roller 110, and a dotted line indicates a temperature transition line of the pressing roller 120, and a centerline (i.e. dash-dot-dash line) indicates a temperature transition line of the pressing roller 120 in accordance with a conventional method. Further, an x-axis represents time, and a y-axis represents temperature. For convenience, the warming-up objective temperature and the warming-up starting temperature occurs where the temperature crosses the temperature transition line, and the objective temperature of the pressing roller occurs where the temperature crosses the temperature transition line.

In the image forming apparatus 100, the heat source 110*a* is turned on at t1 point where the image forming apparatus 100 is on or the wake-up event is generated in the power-saving mode. In accordance with an embodiment of the present invention, the sub-driving body 130 at t1 point starts driving via the applied voltage. On the other hand, the sub-driving body 130 in the prior art does not drive at this point.

Referring again to FIG. 4, between the t1 and t2 interval, the surface temperature of the heated roller 110 is raised by means of the heat source 110*a* being turned on. In an embodiment of the present invention, since the pressing roller 120 and the heated roller 110 rotate, they have a broad contact area. Therefore, heat can be more easily transferred, and the surface temperature of the pressing roller 120 is increased. However, because the pressing roller 120 is heated indirectly, the increasing slope of the temperature transition of the pressing roller 120 is relatively smaller than the increasing slope of the surface temperature of the heated roller 110. The sub-driving body 130 of the related art does not drive during this interval, and thus the contact area between the two rollers is small. As a result thereof, although heat transfer is made between the two rollers, the temperature increase of the pressing roller 120 is rather insignificant.

At the t2 point, when the heated roller 110 reaches the warming-up starting temperature, the image forming apparatus 100 goes into the warming-up mode. For the prior art, this is the point where the sub-driving body 130 starts driving. Thus, from this point, the increasing slope of the surface temperature of the pressing roller 120 of the present invention and the increasing slope of the surface temperature of the pressing roller 120 of the prior art run substantially parallel with each other.

In the t2–t3 interval, not only the surface temperature of the heated roller but also the surface temperature of the pressing roller 120 continuously increase because of the continual driving of the heat source 110*a* and the rotation of the pressing roller 120 in contact with the heated roller 110.

At the t3 point, the surface temperature of the heated roller 110 has reached the warming-up objective temperature, and the heat source 110*a* is turned off.

In the t3–t4 interval, the surface temperature of the heated roller 110 still continues increasing above the warming-up objective temperature because of the remaining heat in the heat source 110*a*, and at a certain point, it gradually decreases. Similarly, the surface temperature of the pressing roller 120 is increased by the heat provided from the heated roller 110, and at a certain point, it gradually decreases.

T4 is a point where the warming-up mode of the image forming apparatus 100 according to an embodiment of the present invention ends. The t4 point is where the surface temperature of the pressing roller 120 has reached the objective temperature thereof. Through this, the heated roller 110 and the pressing roller 120 can retain proper temperatures for image fixing.

On the other hand, at the t4 point, the surface temperature of the pressing roller 120 according to the prior art has not yet reached the objective temperature of the pressing roller 120, so the warming-up mode has not ended, and thus, the sub-driving body 130 and the main driving body (not shown) keep driving even in the t4–t5 interval. Finally, the objective temperature of the prior art pressing roller is reached at the t5 point, and the warming-up mode is ended. That is, the related art requires more time (e.g., t4–t5) for warming up than the present invention.

In conclusion, the image forming apparatus according to an embodiment of the present invention can be advantageously used for reducing the warming-up time period of the image forming apparatus. This in turn reduces waiting time of users and is convenient for users.

Since the warming-up time is reduced, power consumption can be reduced, and thus, the economic burden on the user is reduced. As a result, reliability of the product is improved.

Another problem with the prior art was that the warming-up process ended long after the heat source was turned off. Thus, by the time image fixing occurred, the surface temperature of the heated roller was often lower than desired. However, in an embodiment of the present invention, since the warming-up process ends soon after the heat source is turned off, the surface temperature of the heated roller at the end of the warming-up mode is the desired surface temperature for the heated roller.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations should be apparent to those skilled in the art.

What is claimed is:

1. A warming-up method for an electrophotography image forming apparatus comprising an image fix-related driving body for rotating a heated roller with a built-in heat source and a pressing roller in contact with the heated roller, and a main driving body for rotating an organic photo conductive (OPC) drum, the method comprising the steps of:

heating the rollers by turning on the heat source when the image forming apparatus is turned on or when a wake-up event is generated in power saving mode, and driving the image fix-related driving body for rotating the heated roller and the pressing roller;

driving the main driving body and rotating the OPC drum after driving the image fix-related driving body,; and stopping the image fix-related driving body and the main driving body when a surface temperature of the heated roller and the surface temperature of the pressing roller reach an objective temperature, respectively, by means of heat from the heat source and rotation of the heated roller and the pressing roller.

2. The method according to claim 1, wherein the step of rotating the OPC drum comprises the steps of:

determining whether the surface temperature of the heated roller reaches a warming-up starting temperature, by means of the heat from the heat source and the rotation of the heated roller and the pressing roller; and driving the main driving body and rotating the OPC drum when the surface temperature of the heated roller reaches the warming-up starting temperature.

3. The method according to claim 1, wherein the step of stopping of the sub-driving body and the main driving body comprises the steps of:

determining whether the surface temperature of the heated roller being heated by means of the heat source reached a warming-up objective temperature;

turning off the heat source when the surface temperature of the heated roller reaches the warming-up objective temperature; and stopping the sub-driving body and the main driving body when the surface temperature of the pressing roller to which heat is transferred from the heated roller reaches an objective temperature of the pressing roller.

4. The method according to claim 1, wherein the detection of temperatures is performed with a heat detection device.

5. The method according to claim 4, wherein the heat detection device comprises a thermistor.

6. An apparatus for providing a rapid warming-up period for an electrophotography image forming device, the apparatus comprises:

an image fix-related driving body adapted to rotate a heated roller with a built-in heat source and a pressing roller in contact with the heated roller;

a main driving body adapted to rotate an organic photo conductive (OPC) drum; and a controller adapted to heat the rollers by turning on the heat source when the image forming apparatus is turned on or when a wake-up event is generated in a power saving mode, and drive the image fix-related driving body, drive the main driving body and rotate the OPC drum after driving the image fix-related driving body, and stop the image fix-related driving body and the main driving body when a surface temperature of the heated roller and the surface temperature of the pressing roller reach an objective temperature, respectively, by means of heat from the heat source and rotation of the heated roller and the pressing roller.

7. The apparatus according to claim 6, wherein the controller is further adapted to determine whether the surface temperature of the heated roller reaches a warming-up starting temperature, by means of the heat from the heat source and the rotation of the heated roller and the pressing roller; and drive the main driving body and rotate the OPC drum when the surface temperature of the heated roller reaches the warming-up starting temperature.

8. The apparatus according to claim 7, wherein the controller is further adapted to determine whether the surface temperature of the heated roller being heated by means of the heat source reached a warming-up objective temperature;

turn off the heat source when the surface temperature of the heated roller reaches the warming-up objective temperature; and stop the sub-driving body and the main driving body when the surface temperature of the pressing roller to which heat is transferred from the heated roller reaches an objective temperature of the pressing roller.

9. The apparatus according to claim 7, wherein the detection of temperatures is performed with a heat detection device.

10. The apparatus according to claim 9, wherein the heat detection device comprises a thermistor.

* * * * *